US005251404A

United States Patent [19]

Wasserbaech

[11] Patent Number: 5,251,404

[45] Date of Patent: Oct. 12, 1993

[54] BELT GRINDER FOR CRANKSHAFT PINS

[75] Inventor: Eberhard E. Wasserbaech, Shelby Township, Macomb County

[73] Assignee: General Motors Corporation, Detroit, Mich.

[21] Appl. No.: 994,488

[22] Filed: Dec. 21, 1992

Related U.S. Application Data

[63] Continuation of Ser. No. 843,034, Feb. 28, 1992, abandoned.

[51] Int. Cl.[5] ..... B24B 17/00

[52] U.S. Cl. ..... 51/142; 51/145 R; 51/165.77

[58] Field of Search ..... 51/135 R, 135 BT, 141, 51/145, 148, 165.77, 165.71, 165.78, 328, 105 EC, 142, 144, 326

[56] References Cited

U.S. PATENT DOCUMENTS

| | | | |
|---|---|---|---|
| 2,817,930 | 12/1957 | Bayton, Sr. | 51/148 |
| 3,226,884 | 1/1966 | Mellerski | 51/141 |
| 3,524,284 | 8/1970 | Means | 51/148 |
| 3,885,924 | 5/1975 | Marowsky . | |
| 4,175,358 | 11/1979 | Bischeri . | |
| 4,833,834 | 5/1989 | Patterson et al. . | |
| 4,934,882 | 6/1990 | Phillips . | |
| 4,945,683 | 8/1990 | Phillips . | |
| 5,142,827 | 9/1992 | Phillips . | |

*Primary Examiner*—Bruce M. Kisliuk
*Assistant Examiner*—Jack Lavinder
*Attorney, Agent, or Firm*—Robert J. Outland

[57] ABSTRACT

A belt grinder has a plurality of belts for simultaneously grinding the pins of a crankshaft during crankshaft rotation about its main bearing axis. A shoe for each belt urges the belt against the pin. A profile mechanism including a CNC controller and a servomotor controls each belt by moving the belt against the pin (via the shoe) in a motion for generating a cylindrical pin surface. Guide wheels which guide the belt to and from the shoe are mechanically coupled to the shoe for movement therewith to compensate for the effect of shoe movement on the belt path. A tension wheel maintains a desired tension on the belt and assists the guide wheels in maintaining a constant belt path length. Alternatively, a bias arrangement including an air cylinder applies tension to the belt via the guide wheel. The guide wheel may be retracted by an air cylinder to remove tension for belt removal and replacement.

14 Claims, 3 Drawing Sheets

FIG 1
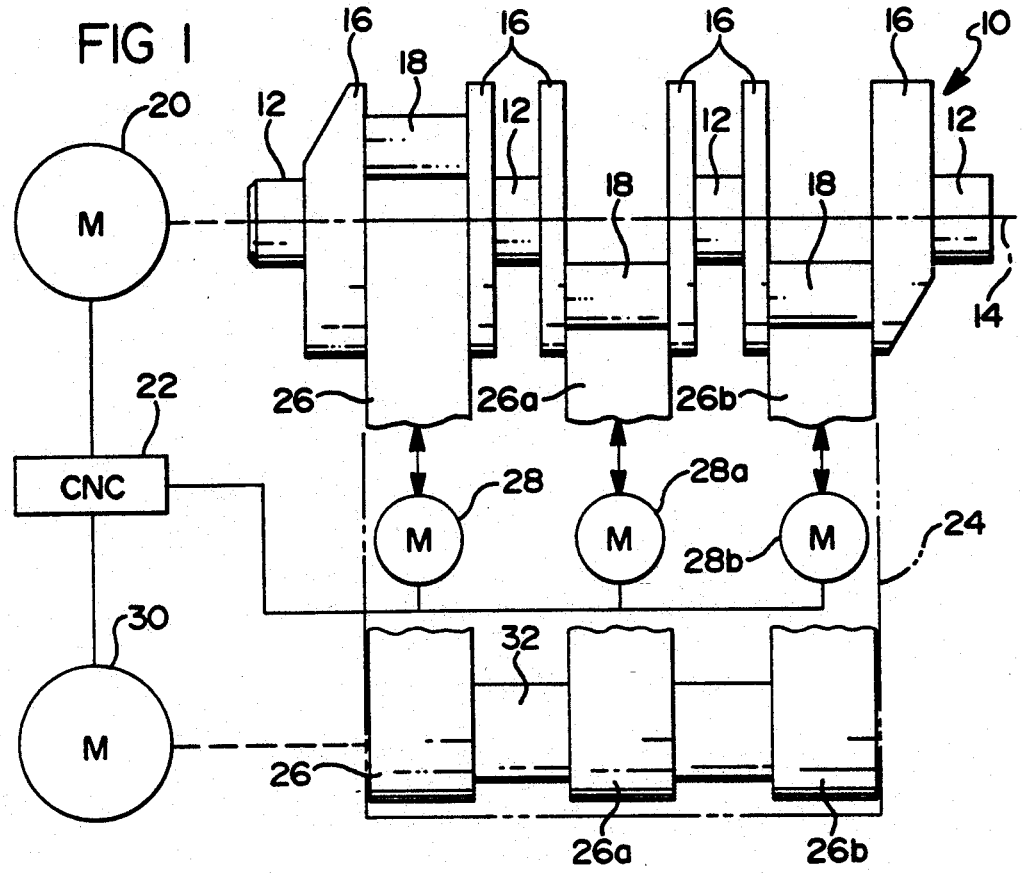
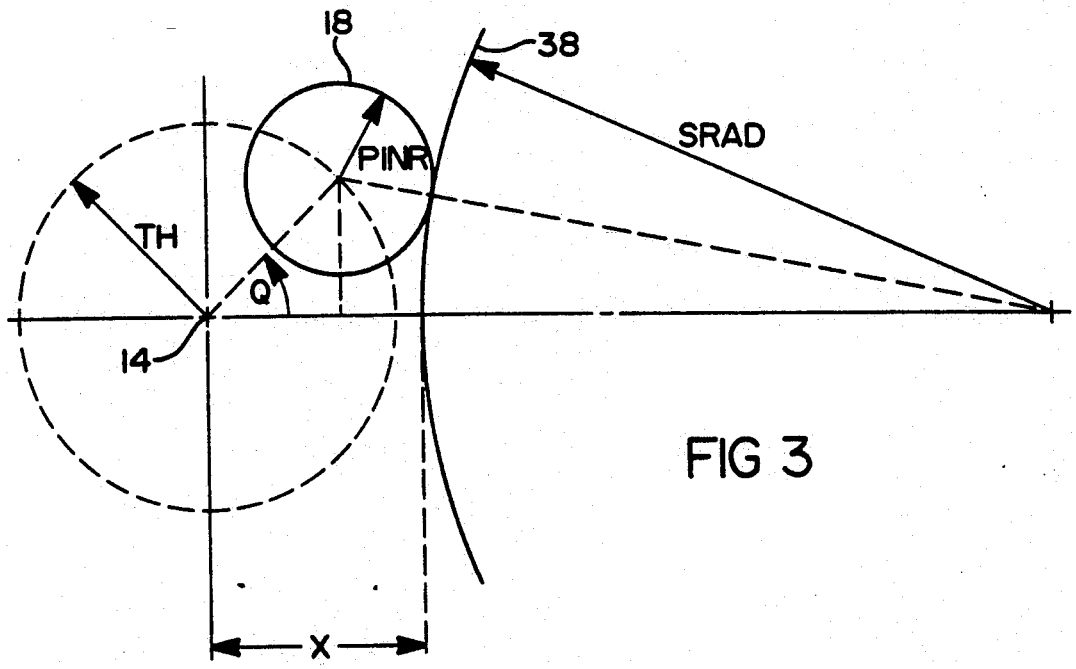
FIG 3

BELT GRINDER FOR CRANKSHAFT PINS

This is a continuation of application Ser. No. 07/843,034 filed on Feb. 28, 1992.

TECHNICAL FIELD

This invention relates to crankshaft pin grinders and particularly to a belt grinder for crankshaft pins.

BACKGROUND

It is known in the art relating to the manufacture of crankshafts to use a grinding wheel to finish grind the crank pins which are eccentrically mounted with respect to the crankshaft axis of rotation. Typically the pins are first rough machined either in milling or turn-broaching operation, and then a pin grinder with a bonded grinding wheel is used to finish grind the pin. The grinding machine dresses the grinding wheel and then the pins are finish ground one pin at a time, thereby resulting in long cycle times. To carry out the grinding step, the crankshaft is rotated about the axis of the pin being ground and must be indexed to another axis of rotation for each differently angled pin. This indexing step further contributes to the long cycle time.

A previously proposed crankshaft grinder allows the crankshaft to be rotated about the axis of its main journals and a grinding wheel is synchronously moved in and out as the crankshaft turns to grind the pin in the correct cylindrical shape. Because of the bulky nature of the grinding machine only one pin at a time can be ground.

It is known in the related art of grinding the cams of camshafts to use a belt grinder. Because several belts can be operated side-by-side it is practical to grind several cams simultaneously. An example of such a cam grinder is shown in U.S. Pat. No. 4,833,834 to Patterson et al, entitled "Camshaft Belt Grinder" which is assigned to the assignee of the present invention, and which is incorporated herein by reference. There the camshaft is rotated about its axis and for each cam, a grinding belt is urged against the cam by a grinding head which is moved in and out according to the desired cam shape. The head motion is coordinated with the camshaft rotation and is driven by a mechanical cam arrangement or by a servo mechanism controlled by a computerized numerical control (CNC) unit. Each belt is driven by a drive wheel and its path is around the head, a pair of stationary guide wheels on either side of the head, and a tension wheel which is biased to maintain a desired tension on the belt and moves transversely to the belt path to compensate for the movement of the head. Since the cam is relatively small, only small movements of the grinding head and of the tension wheel take place.

It is proposed to use a belt grinder similar to the camshaft grinder to grind crankshaft pins. While such an application of a belt grinder may seem to be straightforward, there is a significant difference between the camshaft and the crankshaft application: while the cam is relatively small and requires a small motion of the grinding head, say ⅜ inch, the throw of a crankshaft pin is large and requires a large motion on the order of four inches of the grinding head and a corresponding large motion of the tension wheel if the same apparatus is used. The result is excessive travel of the tension wheel which causes erratic motion of the tension wheel and changes in belt tension during a grind cycle. In addition, the angle of the belt to the head and the tension determine the pressure of the belt against the head. When the head travel is great the angle changes significantly so that the belt pressure is also erratic.

SUMMARY OF THE INVENTION

The present invention provides a belt grinder arrangement which allows a large range of grinder head travel and which compensates for the travel in a way which obviates excessive travel of the tension wheel.

The invention is carried out by a belt grinder having a grinding head for pressing a belt against the workpiece, a contouring mechanism for moving the head as the workpiece turns, a driver for the belt, a tension wheel, and guide wheels which move as the head moves in a direction to at least partially compensate for the head movement.

These and other features and advantages of the invention will be more fully understood from the following descriptions of certain specific embodiments of the invention taken with the accompanying drawings.

BRIEF DRAWING DESCRIPTION

In the drawings:

FIG. 1 is a schematic view of a crankshaft and a multi-station belt grinder system according to the invention;

FIG. 3 is a diagram of the relationship of the belt grinder of FIG. 2 to the crankshaft pin being ground;

DETAILED DESCRIPTION

Figure 2:
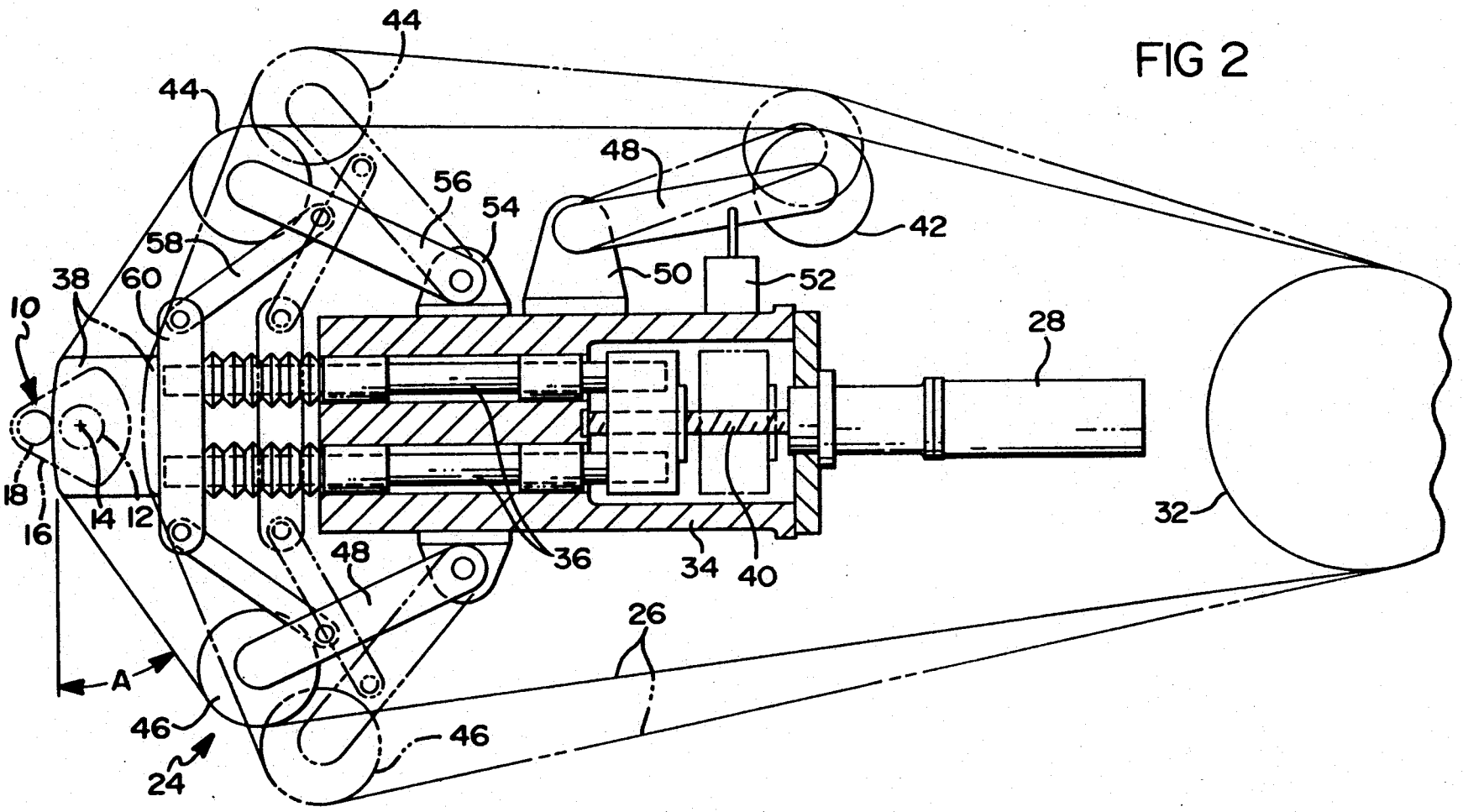
FIG. 2 is a detailed elevation of the belt grinder for one station of the system of FIG. 1.

Referring to FIG. 1, a crankshaft 10 has end and intermediate main bearing journals 12, a plurality of counterweights 16 at the ends of the main journals, and crank pins 18 connecting spaced pairs of counterweights. The journals define the axis 14 of crankshaft rotation and the crank pins 18 are offset from the axis by an amount which establishes the crank throw. The crankshaft is forged or cast and then rough machined prior to finish grinding. To grind the pins, the crankshaft is fixtured and rotated about its axis by a motor 20 under control of a CNC controller 22. This causes the offset pins 18 to move in individual circular orbits about the axis 14. A belt grinder 24 having abrasive belts 26, **26*a* and 26*b* engages the belts with the pins 18. The belts are movable in paths spaced along axis 14 and laterally aligned with their respective crank pins 18. Profile control servomotors 28, 28*a* and 28*b* under control of the CNC 22 continuously and independently position the belts against the pins 18 as the crankshaft rotates to effect a cylindrical profile on each pin. A drive motor 30, also under CNC control, rotates a pulley or drum 32** which drives all the belts.

FIG. 2 illustrates one belt and its associated apparatus. A stationary main support 34 carries a pair of guide bars 36 which mount at their front ends a grinding head including a shoe 38 or in an out movement relative to the crankshaft axis 14. Alternatively, the bars may be replaced by plates guided at each end by a linear bearing. The forward face of the shoe 38 has a large radius of curvature and is finished with a hard surface for pressing the moving belt 26 against the pin 18. The rear ends of the guide bars 36 are coupled to a ball screw 40 which is driven by the servomotor 28 to position the shoe 38. The belt 26 which is driven by the drum 32 passes over a tension wheel 42, an upper guide wheel 44, the shoe 38, and a lower guide wheel 46. The tension wheel 42 is carried by one end of an arm 48 which is pivotally mounted at its other end on a bracket 50 on the support 34. An air cylinder 52 or spring coupled between the support 34 and the arm 48 biases the tension wheel against the belt 26 to supply a prescribed tension to the belt 26. The tension wheel compensates for stretch in the belt which occurs during the life of the belt as well as for small changes in the belt path during each cycle of the head with its shoe 38.

The guide wheels 44 and 46 are each mounted on the support 34 via a bracket 54 and a pivot arm 56. Each pivot arm 56 is journaled to a wheel 44 or 46 at one end and pivoted to a bracket 54 at the other end to permit wheel movement in an arcuate path toward and away from the crankshaft axis 14. The rotational position of each arm 56 is controlled by a link 58 which is coupled between the arm and a bracket 60 secured to the shoe 38 for movement therewith. As the shoe is moved to its full forward position, as shown in solid lines, the guide wheels are retracted to positions nearest the crankshaft axis 14 and when the shoe is moved to its rear position as shown in phantom lines the guide wheels are moved further away from the axis 14.

The principal purpose in moving the guide wheels 44, 46 out as the shoe 38 moves back is to take up most of the slack in the belt due to the shoe movement, that is, to maintain the belt path length substantially constant during each cycle of the shoe travel. The term "belt path" herein refers to the imaginary path established by the belt grinder elements and along which a properly tensioned belt will travel when installed in the grinder. The belt will essentially follow this "belt path" only if the path length is maintained substantially constant and equal to the belt length in actual use. The guide wheel movement approximately compensates for the shoe movement so that the tension wheel will travel only a small amount to maintain the path length and thus keep a constant tension. The tension wheel travel is, however, only a small fraction of the travel which would be needed for the case of stationary guide wheels as known in the prior art.

Another result of moving the guide wheels 44, 46 with the shoe 38 is to minimize the change of belt angle relative to the shoe. For discussion purposes, the belt angle can be approximated by the angle A between the belt and a tangent line to the center of the shoe. If the guide wheels were stationary, the angle A at which the belt approaches or leaves the shoe would change substantially as the shoe moves in and out. The changing angle changes the pressure of the belt against the shoe since the pressure is a function of the belt tension and the angle that the belt makes with the shoe. In this embodiment the wheel movement has a component in the same direction as the head movement, although the amount of travel in that direction is less. The result of the guide wheel movement is that the angle A at which the belt approaches or leaves the shoe is less affected by the shoe movement.

The profile mechanism which includes the CNC controller 22, the servomotor 28 and the ball screw 40 must control the shoe to follow a to and fro motion which maintains the belt at a distance from the center of the pin 18 equal to the pin radius, thereby grinding a cylindrical surface on the pin as the crankshaft rotates. This is accomplished by programming the CNC to carry out the following formula:

$$X=(TH*\cos Q)-SRAD+\{(PINR+SRAD)^2-(TH*\sin Q)^2\}^{\frac{1}{2}};$$

where

X = the distance of shoe from the crankshaft axis
TH = the throw of the crank pin
Q = the angular position of the crank pin
SRAD = radius of the shoe
PINR = crank pin radius, as set forth in the diagram of FIG. 3 which illustrates the setup of crankshaft rotation and profile shoe position. The CNC controller will independently control each of the plurality of belts according to the same formula but at any instant the value of Q will be different for each belt.

Figure 4:
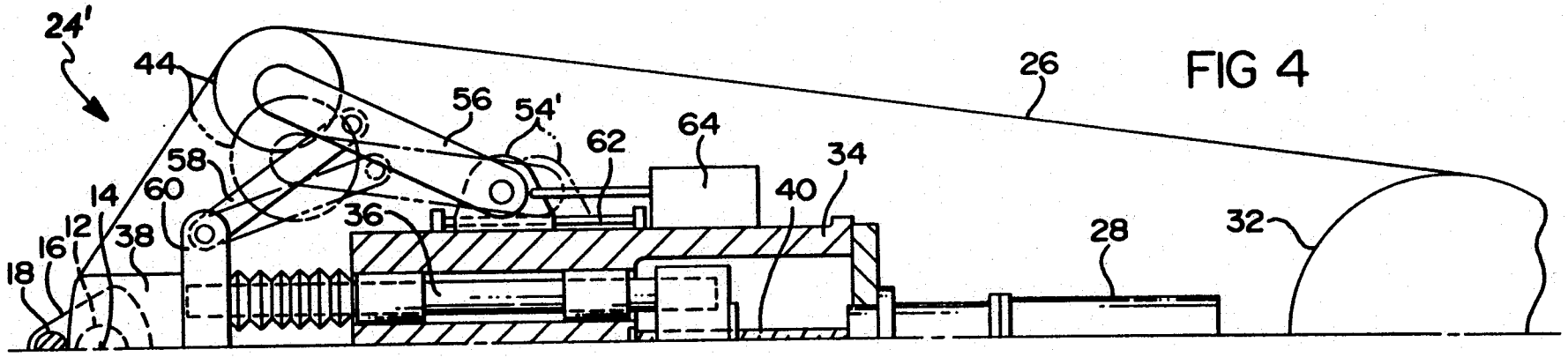
FIG. 4 is a detailed elevation of a second embodiment of the belt grinder according to the invention.

A modification of the belt grinder 24' is shown in FIG. 4 and is in all respects the same as that of FIG. 2 except that the tension wheel 42 and associated structure is omitted and the fixed bracket 54 is changed to a movable bracket 54' which slides fore and aft on guide bars 62 under control of an air cylinder 64. In FIG. 4 only the full forward position of the shoe and guide wheel 44 mechanism are shown along with a phantom view of the wheel 44 and linkage with the bracket 54' retracted. A bracket 54' and air cylinder 64 is provided for each guide wheel 44. The bracket is coupled to one end of the pivot arm 56 and defines the arm pivot axis which is movable. The wheel 44 is journaled at the other end of the pivot arm 56 and applies tension to the belt or releases tension, depending on the effect of the air cylinder 64. The benefit of this sliding bracket is two-fold. First, the tension wheel is eliminated and the guide wheel 44 assumes the tensioning function. The air cylinder 64 urges the bracket 54' forward to push the wheel 44 up against the belt 26. The pressure in the air cylinder 64 is set to a value which affords the desired tension on the belt. Second, to replace the belt, the air cylinder 64 moves the bracket 54' to the rear causing the linkage 56, 58 to retract the wheel 44, as shown in phantom lines, to permit slack in the belt to facilitate its removal and the installation of a replacement. The machine may be stopped at any position of the shoe 38 for such belt replacement and the new belt must be installed at the same shoe position.

Figure 5:
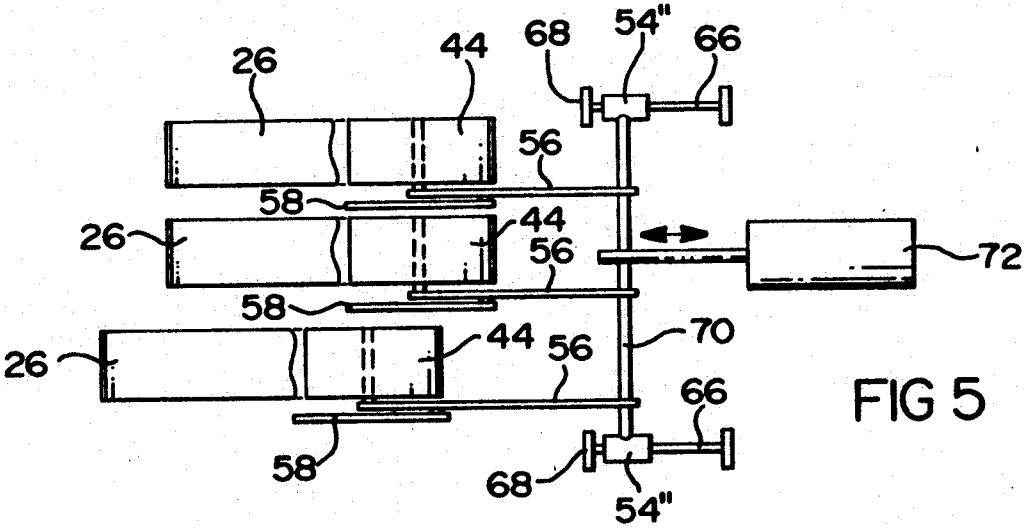
FIG. 5 is a partial view of a modified grinder illustrating a third embodiment according to the invention.

The embodiment of FIG. 5 also uses sliding brackets for ease of belt replacement but still requires the tension wheels 42 of FIG. 2. FIG. 5 is a partial plan view of a multi-head grinder like that of FIG. 1 and shows only the forward portions of the belts 26, the guide wheels 44, the pivot arms 56 and control links 58 for each wheel and a mechanism for changing the pivot axis of the arms 56. That mechanism comprises a pair of movable brackets 54'' slidable fore and aft on guide bars 66 each having a forward stop 68 to establish the forward position of bracket travel. A bar 70 mounted at each end to the brackets 54'' for movement therewith provides the pivot axis of the arms 56 which are journaled on the bar. The position of the bar and the brackets 54'' is controlled by an air cylinder 72. During grinding the machine operates exactly like the FIG. 2 machine with the tension wheel affording the belt tension. When the machine is stopped for belt replacement, the air cylinder is actuated to move the bar 70 back to retract the wheels in the same manner as in the FIG. 4 embodiment. When the belts are replaced, the air cylinder 72 pushes the bar 70 to its full forward position as determined by the stops 68. Then grinder operation may resume.

It will thus be seen that the crankshaft belt grinder disclosed herein is capable of following a path to properly grind the pin of a crankshaft and that the resultant change of belt path due to the large travel of the grinder shoe is compensated for by a tension wheel in conjunction with an arrangement of guide wheels movable as a function of shoe movement, whereby large travel of the tension wheel is not required. An alternative structure having a similar effect is to mount the lower guide wheel at a stationary position and move only the upper guide wheel as a function of the shoe movement.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. Apparatus for grinding crankshaft pins during rotation of the crankshaft about its main journals, the apparatus comprising a belt grinder including:

an abrasive belt of substantially constant length for grinding a crankshaft pin;

stationary drive means having a rotatable member engaging the belt for driving the belt in a closed path;

a grinding shoe engaging the side of the belt opposite the pin at the location of belt engagement with the pin for holding the belt against the pin, the shoe being spaced from the driving means;

means for moving the grinding shoe in cycles to maintain the belt against the pin as the crankshaft turns, the shoe movement varying the spacing of the shoe from the driving means, thereby altering the shape of the belt path; and means for adjusting the belt path during each cycle of shoe movement to maintain a substantially constant path length equal to the belt length, the adjusting means including;

belt guide means engaging the belt closely adjacent to the shoe and movable toward and away from the shoe for alternately shortening and lengthening the portion of the belt path between the guide means and the shoe to compensate for the effect of shoe travel on the path length while also maintaining substantially constant a predetermined angle of the belt relative to the shoe.

2. The invention as defined in claim 1 wherein the apparatus includes a plurality of belts each for grinding a separate crankshaft pin;

a grinding shoe, shoe moving means, and guide means associated with each belt;

each guide means comprising a guide wheel supported on a pivot arm and moved in an arcuate path by a link coupled between the pivot arm and the grinding shoe; and means for retracting the guide means from an operating position to facilitate belt removal and replacement comprising movable pivot means for the pivot arms, and actuator means coupled to the pivot means for selectively moving the pivot arms in one direction to retract the guide means and in the opposite direction to return the guide means to an operating position.

3. The invention as defined in claim 2 wherein the movable pivot means is a common pivot element coupled to all of the pivot arms and the actuator means is a single actuator coupled to the common pivot element.

4. The invention as defined in claim 1 wherein the belt guide means comprises at least one guide wheel supported on a pivot arm and moved in an arcuate path by a link coupled between the pivot arm and the grinding shoe, whereby the guide wheel movement compensates for the movement of the grinding shoe.

5. The invention as defined in claim 1 wherein the belt guide means comprises a pair of guide wheels on the belt path before and after the shoe, each guide wheel being supported on a pivot arm and moved in an arcuate path by a link coupled between the pivot arm and the grinding shoe, whereby the guide wheel movement compensates for the movement of the grinding shoe.

6. The invention defined in claim 1 and further including belt tensioning means acting on the belt through the belt guide means to maintain belt tension.

7. The invention defined in claim 1 and further including belt tensioning means separate from the belt guide means and movable against the belt to maintain belt tension, movement of the guide means also being effective to minimize travel of the tensioning means.

8. A crankshaft belt grinder having a grinding belt for grinding an off-axis crankshaft pin, said grinder comprising:

means for rotatably supporting a crankshaft about an axis to rotate the crankshaft pin in an orbit around the axis;

fixedly mounted means for driving the belt;

means for tensioning the belt;

actuating means operative to engage the belt for urging the belt into grinding contact with the pin including belt engaging means engaging the side of the belt opposite the pin, and control means drivingly coupled to the belt engaging means and operative to advance and withdraw the belt engaging means to cause the belt to grind the pin surface in a cylindrical configuration; and belt guide means establishing a predetermined angle of belt contact with the belt engaging means and movable toward and away from the belt engaging means in correspondence with advancing and withdrawing motion of the belt engaging means relative to the pin, to adjust the belt path length to compensate for travel of the belt engaging means by varying the portion of the belt length between the guide means and the belt engaging means and to limit the variation of said belt contact angle with the belt engaging means.

9. The invention as defined in claim 8 wherein the belt guide means comprises at least one wheel engaging the belt and constrained for movement with the belt engaging means and having a component of motion in the same direction as the motion of the belt engaging means.

10. The invention as defined in claim 8 wherein the belt guide means comprises a pair of wheels engaging the belt, each wheel being mounted on a pivot arm for movement toward and away from the crankshaft axis, and a control link connected between the belt engaging means and each pivot arm for effecting such wheel movement for changing the path of the belt.

11. Apparatus for grinding crankshaft pins during rotation of the crankshaft about its main journals, the apparatus comprising a belt grinder including:

an abrasive belt of substantially constant length for grinding a crankshaft pin;

stationary drive means having a rotatable member engaging the belt for driving the belt in a closed path;

a grinding shoe for holding the belt against the pin, the shoe being spaced fro the driving means;

means for moving the grinding shoe in cycles to maintain the belt against the pin as the crankshaft turns, the shoe movement varying the spacing of the shoe from the driving means, thereby altering the shape of the belt path;

means for adjusting the belt path to maintain a substantially constant path length equal to the belt length during each cycle of shoe movement, the adjusting means including;

belt guide means engaging the belt adjacent to the shoe and moveable toward and away from the shoe for alternately shortening and lengthening the portion of the belt path between the guide means and the shoe to compensate for the effect of shoe travel on the path length; and belt tensioning means for maintaining tension on the belt.

12. The invention as defined in claim 11 wherein the belt guide means comprises a guide wheel supported on one end of a pivot arm, the other end of the pivot arm having a pivot axis, the guide wheel being moved in an arcuate path by a link coupled between the pivot arm and the grinding shoe, whereby the guide wheel movement compensates for the movement of the grinding shoe; and the belt tensioning means comprises biasing means coupled to the pivot arm for urging the pivot axis in a direction to apply a force through the pivot arm to the belt.

13. The invention as defined in claim 12 wherein the pivot axis is defined by a movable bracket; and the biasing means comprises an air cylinder coupled to the pivot arm through the movable bracket.

14. The invention as defined in claim 13 wherein the air cylinder is double acting and moves the bracket in one direction to apply a tensioning force to the belt and moves the bracket in the other direction to retract the guide wheel for tension release, thereby facilitating the removal and replacement of the belt.

* * * * *